US007347009B2

(12) United States Patent
Ahn et al.

(10) Patent No.: US 7,347,009 B2
(45) Date of Patent: Mar. 25, 2008

(54) CLOTHES DRYER WITH A DEHUMIDIFIER

(75) Inventors: Seung Phyo Ahn, Gyeongsangnam-Do (KR); Jung Wook Moon, Gyeongsangnam-Do (KR); Dae Woong Kim, Gyeongsangnam-Do (KR); Seung Myun Baek, Gyeongsangnam-Do (KR); Byeong Jo Ryoo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/292,313

(22) Filed: Dec. 2, 2005

(65) Prior Publication Data

US 2006/0117593 A1 Jun. 8, 2006

(30) Foreign Application Priority Data

Dec. 7, 2004 (KR) ..... 10-2004-0102567

(51) Int. Cl.
*F26B 7/00* (2006.01)

(52) U.S. Cl. ..... 34/607

(58) Field of Classification Search ..... 34/513, 34/607

See application file for complete search history.

(56) References Cited

U.S. PATENT DOCUMENTS 2,752,694 A * 7/1956 McCormick ..... 34/60
7,036,243 B2 * 5/2006 Doh et al. ..... 34/595
2005/0246920 A1 * 11/2005 Yabuuchi et al. ..... 34/515

* cited by examiner

*Primary Examiner*—S. Gravini
(74) *Attorney, Agent, or Firm*—Ked & Associates LLP

(57) ABSTRACT

A clothes dryer with a dehumidifier is disclosed. The clothes dryer includes a cabinet, a drying container rotatably installed in the cabinet, a driving unit for supplying a rotational force to the drying container, a first air passage connected to a side of the drying container and including a first heat exchanger, a second air passage connected to another side of the drying container and the outer side of the cabinet, and a third air passage including a second heat exchanger for dehumidifying external air of the drying container. The clothes dryer of the present invention performs drying process and dehumidifying process, the clothes dryer can prevent room humidity from increasing.

19 Claims, 5 Drawing Sheets

CLOTHES DRYER WITH A DEHUMIDIFIER

BACKGROUND

1. Field of the Invention

The present invention relates to a clothes dryer, and more particularly, to a clothes dryer with a dehumidifier.

2. Discussion of Related Art

Clothes dryers can be classified into a discharge type clothes dryer and a condensation type clothes dryer according to treat moisture generated during drying clothes. The former discharges out moisture generated from the dryer, and the latter condenses and removes the moisture generated from the dryer and circulates air from which the moisture is removed to the dryer.

Generally, in the discharge type clothes dryer, an inlet duct and an outlet duct are connected to a drum rotatably installed in a cabinet, and the inlet duct includes a heater.

When a fan is driven, air out of the clothes dryer enters the inlet duct and heated at a high temperature, about 100° C. by the heater. As such, high-temperature air enters to dry clothes in a dry drum of the clothes dryer. During the drying process, the high-temperature air contains moisture contained in the clothes and high-moisturized air is discharged out through the discharge duct.

As such, according to the conventional clothes dryer for transferring heat to the introduced air using the heater, air is rapidly heated by the heater so the drying time can be shortened and the conventional clothes dryer can be manufactured in a big size, however, since air is heated by the heater, the energy consumption is high. Especially, since clothes are dried by a high-temperature air of about 100° C. and more, the clothes may be damaged.

The condensation type clothes dryer can be manufactured in a built-in type and has higher energy efficiency than that of the discharge type clothes dryer because there is not necessary for a discharge duct for discharging air out of the conventional clothes dryer, however, the condensation type clothes dryer needs a long drying time and is difficult to manufacture in a big size.

Under the situation as described above, an improved clothes dryer with high efficiency for preventing clothes from damage should be required.

Meanwhile, the discharge type clothes dryer discharges air containing a great deal of moisture to increase the humidity in a room during the drying process. In the regions, such as a long monsoon region or a coast region, the humidity is increased by the use of the clothes dryer.

Thus, there is a need of a clothes dryer capable of dehumidifying during the drying process.

SUMMARY OF THE INVENTION

The present invention has been made in view of the above and/or other problems, and it is an object of the present invention to provide a clothes dryer of a high energy-efficiency and low power consumption.

It is another object of the present invention to provide a clothes dryer having a low possibility of clothes being damaged due to high temperature air during the drying process.

It is still another object of the present invention to provide a clothes dryer capable of dehumidifying air during the drying process.

It is still another object of the present invention to provide a compact clothes dryer for space-saving.

In order to achieve the above objects and another aspect of the present invention, the present invention provides a clothes dryer including a cabinet, a drying container rotatably installed in the cabinet, a driving unit for supplying a rotational force to the drying container, a first air passage connected to a side of the drying container and having a first heat exchanger, a second air passage connected to an opposite side of the drying container and the outer side of the cabinet, and a third air passage having a second heat exchanger for dehumidifying external air of the drying container.

Preferably, the third air passage penetrates the cabinet or is formed outside the cabinet.

The first heat exchanger and the second heat exchanger form a thermodynamic cycle by a separate compressor and an expansion device, and a pipe for connecting the compressor and the expansion device. The first heat exchanger increases temperature of the entered air through heat exchange.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Figure 1:
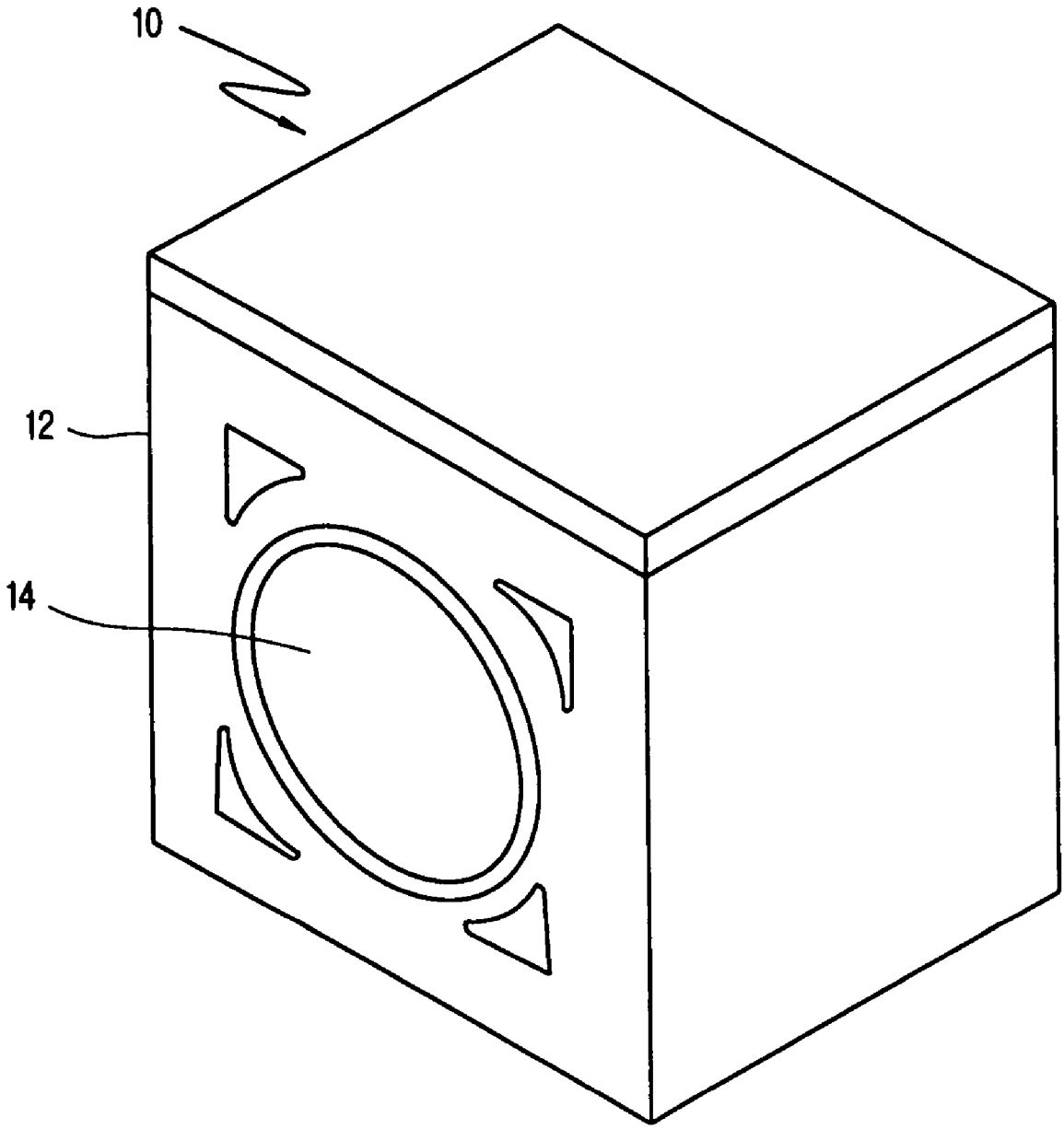
FIG. 1 is a perspective view illustrating an external appearance of a clothes dryer according to a preferred embodiment of the present invention.
Figure 2:
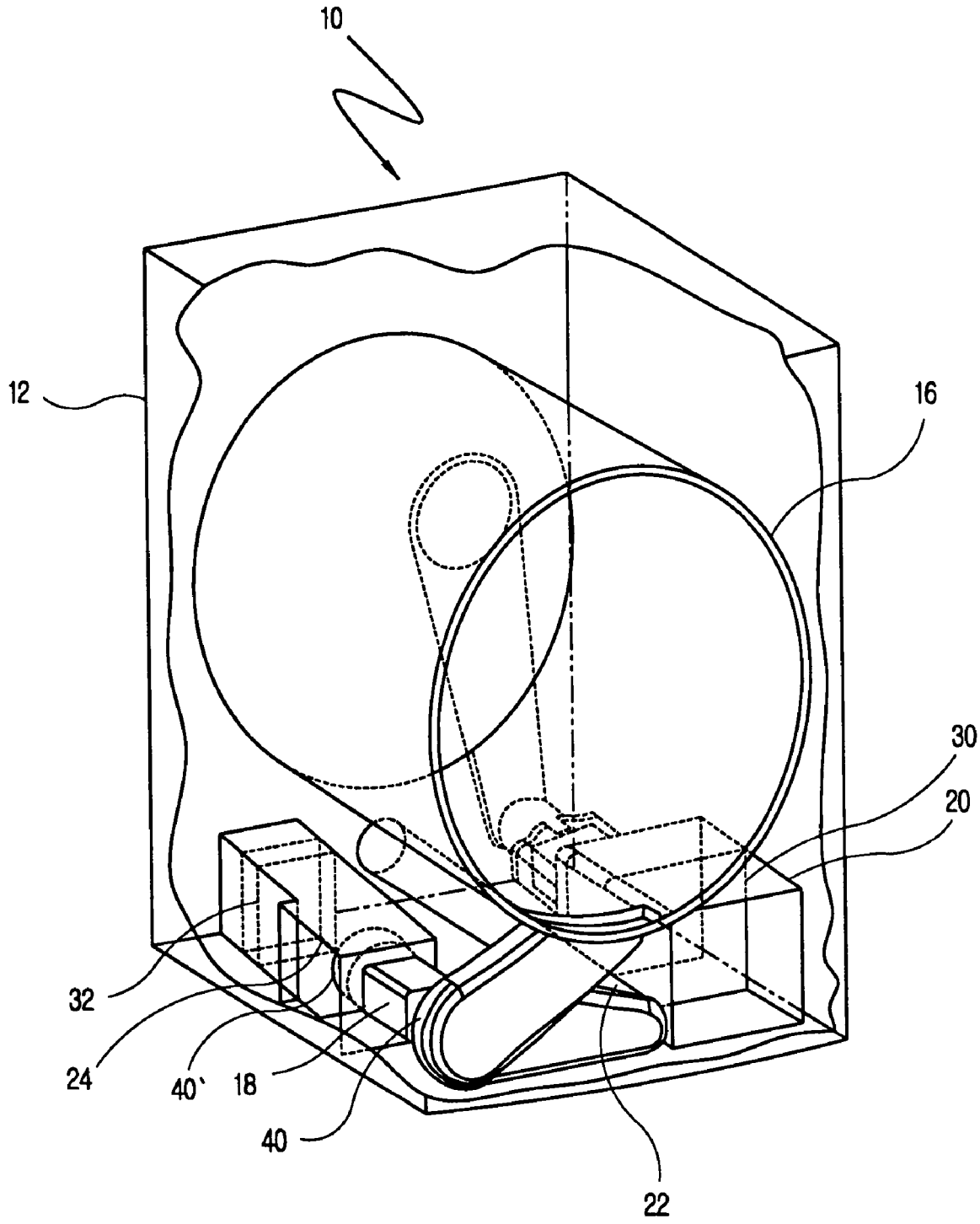
FIG. 2 is a perspective view illustrating an inner structure of the clothes dryer according to the preferred embodiment of the present invention.
Figure 3:
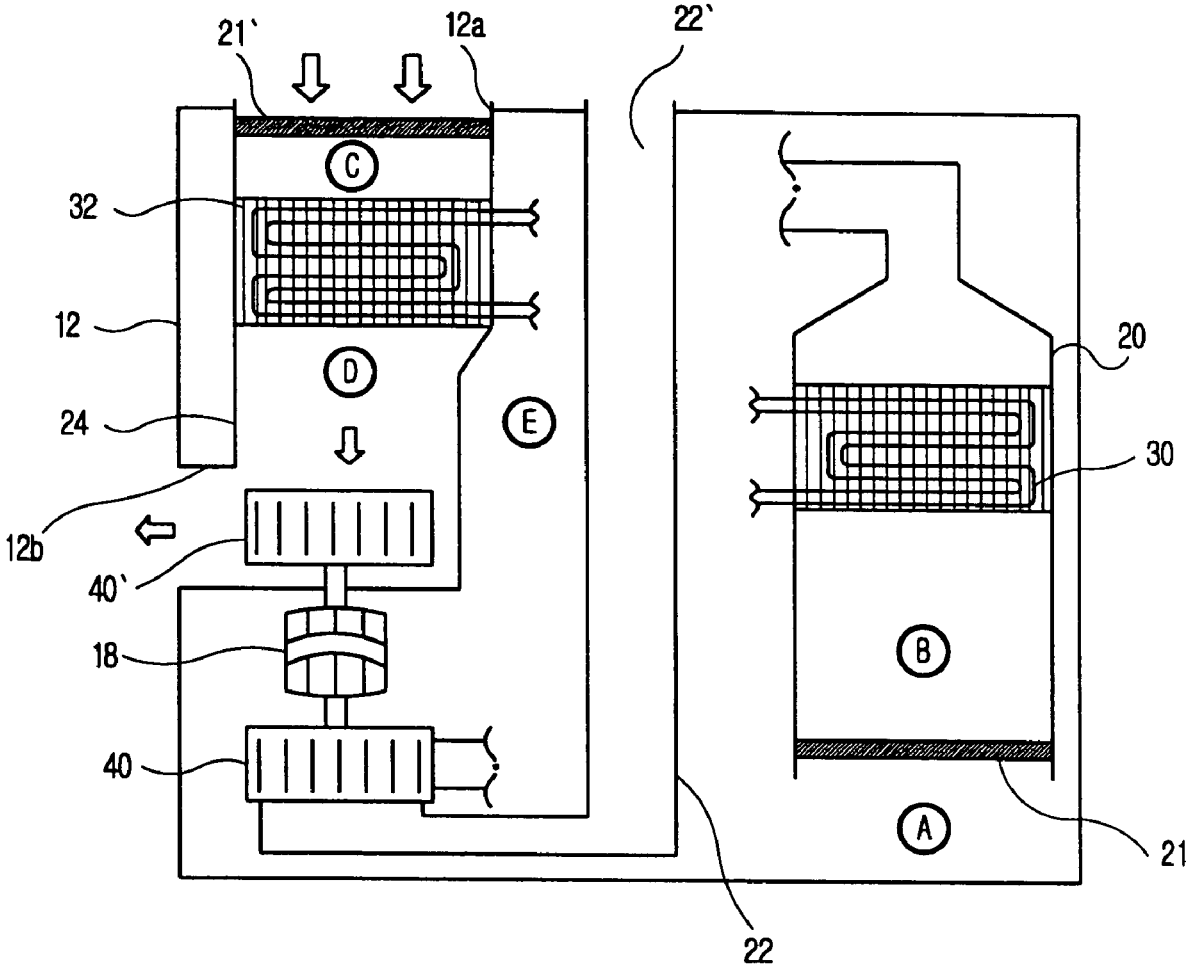
FIG. 3 is a plan view illustrating a lower structure of the clothes dryer according to the preferred embodiment of the present invention.

FIG. 1 shows an example of a clothes dryer 10 according to a preferred embodiment of the present invention. An empty cabinet 12 includes an entrance 14 through which clothes are inserted into and extracted from the cabinet 12, and a drying container is rotatably installed in the cabinet 12. The inner structure of the cabinet 12 is illustrated in FIG. 2 in detail, and components installed in the lower side of the clothes dryer are illustrated in FIG. 3.

The drying container 16 has a cylindrical shape and rotates about an axis substantially parallel to the bottom surface of the cabinet 12. The drying container 16 is rotated by a driving force from a driving unit 18 (for example a motor), installed in the lower side thereof, preferably, on the bottom of the cabinet 12. Generally, a rotation force transfer means may be a belt 42 extending from a driving shaft of the driving unit 18 to the outer circumference of the drying container 16. As following description, the driving unit 18 can transfer the rotational force to a fan 40 installed in a second air passage 22 to cause airflow.

A side of the drying container 16 is connected to a first air passage 20 and the opposite side is connected to the second air passage 22 through which air discharged from the drying container flows. An inlet of the first air passage 20 may not be exposed to the exterior, but an outlet 22' of the second air passage 22 is preferably exposed to the exterior of the cabinet 12.

The first air passage 20 includes a first heat exchanger 30. The first heat exchanger 30 is a condenser to heat air entering the first air passage 20 at a high temperature. Thus, the air passed through the first air passage 20 is heated at a high temperature and enters the drying container 16. The first air passage 20 may include a filter 21 for removing dust contained in air entering the inlet.

Moreover, the cabinet 12 further includes a third air passage 24 as another air passage unconnected to the drying container 16. The cabinet 12 includes a separate third air passage 24. The third air passage 24 includes an inlet 24*a* and an outlet formed in the rear side and the lateral side of the cabinet 12, respectively, so that the third air passage 24 penetrates the cabinet 12. However, unlikely as in FIG. 2, the third air passage can be formed as a separate duct installed outside the cabinet.

In the third air passage 24, a second heat exchanger 32 is installed. The second heat exchanger 32 is an evaporator for absorbing heat from air entering the second heat exchanger by heat exchange to dehumidify. When a dehumidifying fan 40' installed in the third air passage 24 is driven, air entering the inlet 12*a* is dehumidified and is discharged through the outlet 12*b*. The dehumidifying fan 40' receives the rotational force from the driving unit 18. The third air passage 24 may include a filter 21' for removing dust from air entering the inlet.

Preferably, the first heat exchanger 30 and the second heat exchanger 32 form a thermodynamic cycle, and to this end, the cabinet 12 further includes a compressor 34 and an expansion device 36. The compressor 34 and the expansion device 36 are preferably installed in the lower side of or lower than the drying container, and is connected to the first heat exchanger 30 and the second heat exchanger 32 by a pipe 38 to form a closed loop for a thermodynamic cycle. This cycle is a kind of a vapor compressing cycle, and serves as a heat pump with respect to air flowing through the first air passage 30.

The second air passage 22 includes an air flowing fan 40. Preferably, the fan 40 is a multiple blade sirocco fan. The fan 40 receives the rotational force from the driving unit 18 and generates airflow discharged out through the second air passage 22 via the drying container 16.

Meanwhile, the compressor 34 as a component of the vapor compressing cycle may be installed at a position (for example, a position 'E' in FIG. 3) in the cabinet, especially, inside or in the front side of the first air passage 20 (for example, a position 'A' or 'B' in FIG. 3), or in the third air passage (for example, a position 'C' or 'D' in FIG. 3). The compressor 34 is installed in the first air passage 20 or in the third air passage 24 so that the compressor 34 is cooled due to the heat exchange between the compressor and air, thereby increasing efficiency of the compressor.

Figure 4:
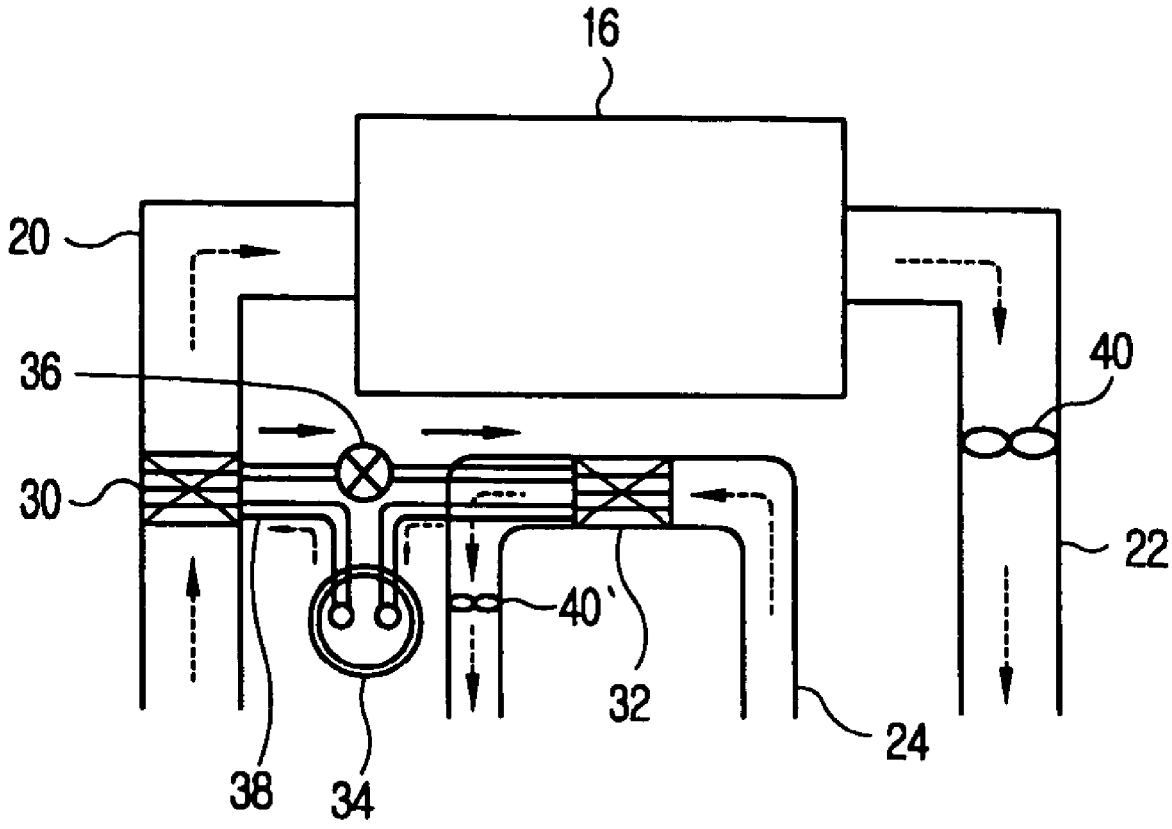
FIG. 4 is a schematic view illustrating flows of refrigerant and air in the clothes dryer according to the preferred embodiment of the present invention.

FIG. 4 is a schematic view illustrating refrigerant flow in the vapor compressing cycle and airflow in the air passages in the clothes dryer according to the preferred embodiment of the present invention.

In the pipe 38 for connecting every component of the cycle, refrigerant flows from the first heat exchanger 30 to the second heat exchanger 32 via the expansion device 36, and from the second heat exchanger 32 to the first heat exchanger 30 via the compressor 34 again. The flowing direction of refrigerant is indicated with solid arrows.

Air entering the first air passage 20 passes through the first heat exchanger 30 to enter the drying container 16, and is discharged out through the second air passage 22, and this flowing direction is indicated with dotted arrows.

Moreover, airflow that enters the third air passage 24 and discharged out is indicated with dotted arrows.

Preferably, every component, that is, the first heat exchanger 30, the second heat exchanger 32, the compressor 34, the expansion device 36, and the pipe 38 for connecting them are installed in the cabinet, especially in the lower side of the drying container 16. To this end, at least a part of the first air passage 20 is preferably installed in the lower side of the drying container 16, and the third air passage 24 and the rest components are installed lower than the drying container, preferably, on the bottom surface of the cabinet.

Due to the arrangement, there is no need to increase the volume of the cabinet so that the inner space can be used effectively, thereby compacting the clothes dryer. When the components are exposed to the exterior or the volume of the cabinet is increased, the installation space of the clothes dryer is increased so that spatial efficiency will be also deteriorated.

Figure 5:
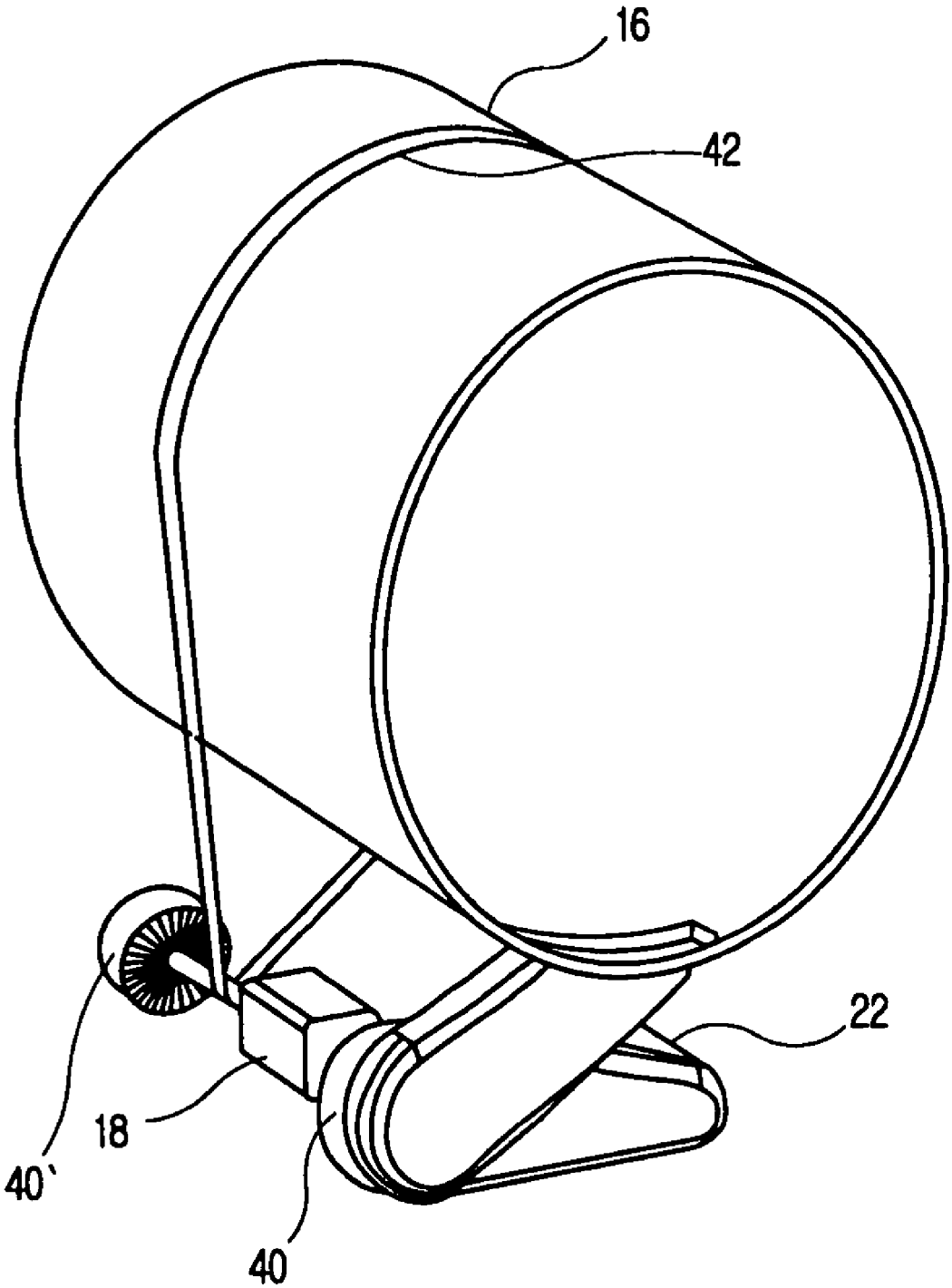
FIG. 5 is a perspective view illustrating a part of the clothes dryer according to the preferred embodiment of the present invention.

FIG. 5 illustrates a part of the clothes dryer according to the preferred embodiment of the present invention. As shown in the drawing, the outer circumference of the drying container 16 is wound with the belt 42 connected to the driving unit 18 to transfer the rotational force to the drying container 16. The driving unit 18 is connected to the fan 40 installed in the second air passage 22 and drives the fan 40. Moreover, the dehumidifying fan 40' is connected to the driving unit 18 to receive the driving force.

Thus, the driving unit 18 can rotate the drying container 16 and the two fans 40 and 40' simultaneously. As such, only a single driving unit 18 drives the drying container 16 and the fans 40 and 40' so that the spatial efficiency is increased and there is no need for additional devices.

Drying process of the clothes dryer according to the preferred embodiment of the present invention will be described as follows.

When the fan 40 is driven by the driving unit 18, a suction force is generated so that external air enters the inlet of the first air passage 20. The entered air is changed into a hot air while passing through the first heat exchanger 30 and reaches a side of the drying container 16. Temperature of air reached the drying container is maintained at about 50 degrees centigrade to 75 degrees centigrade. The air maintaining such a high temperature can dry the clothes in the drying container 16 without damage.

The hot air entered the drying container 16 contacts the clothes containing moisture to transfer heat to the clothes and absorbs moisture from the clothes, and is changed into high humid air and discharged out of the drying container. The air discharged from the drying container is discharged to the exterior of the cabinet 12 through the second air passage 22.

In addition to the drying process, the external air enters the third air passage and is dehumidified by the heat exchange with the second heat exchanger 32, and then is discharged out. Thus, even when a great deal of humid air is discharged out of the clothes dryer, humidity of room does not increase. According to circumstances, the dryer may be driven without clothes in the drying container 16. In this case, only dehumidifying process is performed without discharge of humid air from the dryer so that room air may be dried.

Although a few embodiments of the present invention have been shown and described, it would be appreciated by those skilled in the art that changes might be made in this embodiment without departing from the principles and spirit of the invention, the scope of which is defined in the claims and their equivalents.

As described above, since the clothes dryer of the present invention performs drying process and dehumidifying process, the clothes dryer can prevent room humidity from increasing.

Moreover, since a system for generating heat using a vapor compressing cycle is used as a device for supplying heat to air, heating performance is two or three times of that of the heater style system when using same power consumption, thereby decreasing power consumption.

Moreover, in comparison to the drying process of the heater style dryer, since temperature of air entering the drying container is low, clothes to be dried can be prevented from damage.

Additionally, since the clothes dryer of the present invention has a small volume and a small space for installation, the room space can be effectively used.

What is claimed is:

1. A clothes dryer comprising:

a cabinet;

a drying container rotatably installed in the cabinet;

a driving device that supplies a rotational force to the drying container;

a first air passage connected to a side of the drying container and including a first heat exchanger;

a second air passage connected to another side of the drying container and the outer side of the cabinet; and a third air passage including a second heat exchanger comprising an evaporator that dehumidifies air external of the drying container.

2. The clothes dryer as claimed in claim 1, wherein the third air passage penetrates the cabinet.

3. The clothes dryer as claimed in claim 1, wherein the third air passage is formed outside the cabinet.

4. The clothes dryer as claimed in claim 1, wherein the third air passage includes a fan that creates airflow.

5. The clothes dryer as claimed in claim 1, wherein the first heat exchanger increases a temperature of air through heat exchange.

6. The clothes dryer as claimed in claim 1, wherein the first heat exchanger and the second heat exchanger form a thermodynamic cycle by a separate compressor and an expansion device, and wherein at least one pipe connects the separate compressor and the expansion device to the first and second heat exchanger to form a closed loop for the thermodynamic cycle.

7. The clothes dryer as claimed in claim 6, wherein the compressor and the expansion device are installed in the lower side of the drying container.

8. The clothes dryer as claimed in claim 1, wherein the first air passage, the second air passage, and the third air passage are installed in the lower side of the drying container.

9. The clothes dryer as claimed in claim 1, wherein the cabinet includes an entrance through which clothes are inserted into and extracted from the cabinet.

10. The clothes dryer as claimed in claim 1, further comprising a filter disposed in at least one of the first air passage or the second air passage.

11. The clothes dryer as claimed in claim 1, wherein the second air passage includes a fan configured to create airflow.

12. The clothes dryer as claimed in claim 1, wherein the second air passage and the third air passage each contain a fan, and the fans are both driven by the driving device.

13. The clothes dryer as claimed in claim 1, wherein the first heat exchanger comprises a condenser.

14. A clothes dryer, comprising:

a cabinet;

a drying container rotatably installed in the cabinet;

a first air passage in fluid communication with a first side of the drying container and including a first heat exchanger;

a second air passage in fluid communication with a second side of the drying container; and a third air passage including a second heat exchanger configured to dehumidify air external of the drying container, wherein the third air passage is formed separate from the first and second air passages and includes an inlet and outlet formed in the walls of the cabinet.

15. The clothes dryer as claimed in claim 14, wherein the first heat exchanger and the second heat exchanger form a thermodynamic cycle with a separate compressor and an expansion device, and wherein at least one pipe connects the separate compressor and the expansion device to the first and second heat exchangers to form a closed loop of the thermodynamic cycle.

16. The clothes dryer as claimed in claim 14, wherein the first air passage, the second air passage, and the third air passage are installed in the lower side of the drying container.

17. The clothes dryer as claimed in claim 14, wherein the second air passage and the third air passage each contain a fan, and the fans are both driven by a drive device which also supplies a rotational force to the drying container.

18. The clothes dryer as claimed in claim 14, wherein the first exchanger comprises a condenser.

19. The clothes dryer as claimed in claim 14, wherein the second heat exchanger comprises an evaporator.

* * * * *